US006525281B2

(12) United States Patent
Quapil

(10) Patent No.: US 6,525,281 B2
(45) Date of Patent: Feb. 25, 2003

(54) EMERGENCY CALL BUTTON FOR VEHICLES, IN PARTICULAR, MOTOR VEHICLES

(75) Inventor: Olaf Quapil, Backnang (DE)

(73) Assignee: Reitter & Schefenacker GmbH & Co. KG, Esslingen (DE)

( * ) Notice: Subject to any disclaimer, the term of this patent is extended or adjusted under 35 U.S.C. 154(b) by 0 days.

(21) Appl. No.: 09/902,991

(22) Filed: Jul. 11, 2001

(65) Prior Publication Data

US 2003/0010613 A1 Jan. 16, 2003

(51) Int. Cl.[7] ..... H01H 9/28
(52) U.S. Cl. ..... 200/43.01; 200/61.86
(58) Field of Search ..... 200/60.86, 43.01, 200/43.04, 465–467, 470–472, 6 BB

(56) References Cited

U.S. PATENT DOCUMENTS 5,187,630 A * 2/1993 MacKay et al. ..... 200/565
5,539,165 A * 7/1996 Wu ..... 200/43.04
5,583,327 A * 12/1996 Black, III ..... 137/560
5,593,023 A * 1/1997 Kaizaki et al. ..... 200/14
5,711,415 A * 1/1998 Fukuda et al. ..... 200/4
6,262,378 B1 * 7/2001 Chou ..... 200/18

FOREIGN PATENT DOCUMENTS

DE 2226454 * 6/1990

* cited by examiner

*Primary Examiner*—Lincoln Donovan
*Assistant Examiner*—Lisa Klaus
(74) *Attorney, Agent, or Firm*—Gudrun E. Huckett

(57) ABSTRACT

An emergency call button for motor vehicles has at least one actuator part and one or more triggers, wherein the actuator part acts in a triggering position on one of the one or more triggers for triggering an emergency call. The actuator part has a rest position and is secured in the rest position against movement into the triggering position. A spring is provided that locks the actuator part in the rest position. The actuator part is axially movable against the force of the spring from the rest position into a release position and is rotatable in the release position about an axis of rotation in order to reach the triggering position.

57 Claims, 5 Drawing Sheets

EMERGENCY CALL BUTTON FOR VEHICLES, IN PARTICULAR, MOTOR VEHICLES

BACKGROUND OF THE INVENTION

1. Field of the Invention

The invention relates to an emergency call button for vehicles, in particular, for motor vehicles, comprising at least one actuator part for actuating at least one trigger by being movable out of a rest position.

2. Description of the Related Art

In connection with motor vehicles, it is known to trigger an alarm with the police or an automotive roadside assistance service in a dangerous situation, for example, in the case of an accident or a vehicle break down, by means of a pre-programmed communication sending device.

SUMMARY OF THE INVENTION

It is an object of the present invention to provide an emergency call button for a vehicle in which in a simple way an emergency call can be triggered but an accidental actuation of the button, for example, by children, can be reliably prevented.

In accordance with the present invention, this is achieved in that the actuator part is secured in its rest position against movement.

As a result of the embodiment according to the invention, the actuator part is locked against actuation in its rest position. In order to trigger the emergency call, first the locking action of the actuator part must be deactivated and then the actuator part must be moved from this release position into a position for triggering the emergency call. Accordingly, the emergency call button can trigger the emergency call only when at the same time two different courses of movement are carried out. These different courses of movement cannot be performed accidentally, for example, by playing children. Accordingly, this switch or button is secured reliably against accidental triggering. Still, when the operator is familiar with the courses of movement, the switch can be actuated in a simple way so that in an emergency situation the emergency call can be quickly triggered.

DESCRIPTION OF THE PREFERRED EMBODIMENTS

Figure 1:
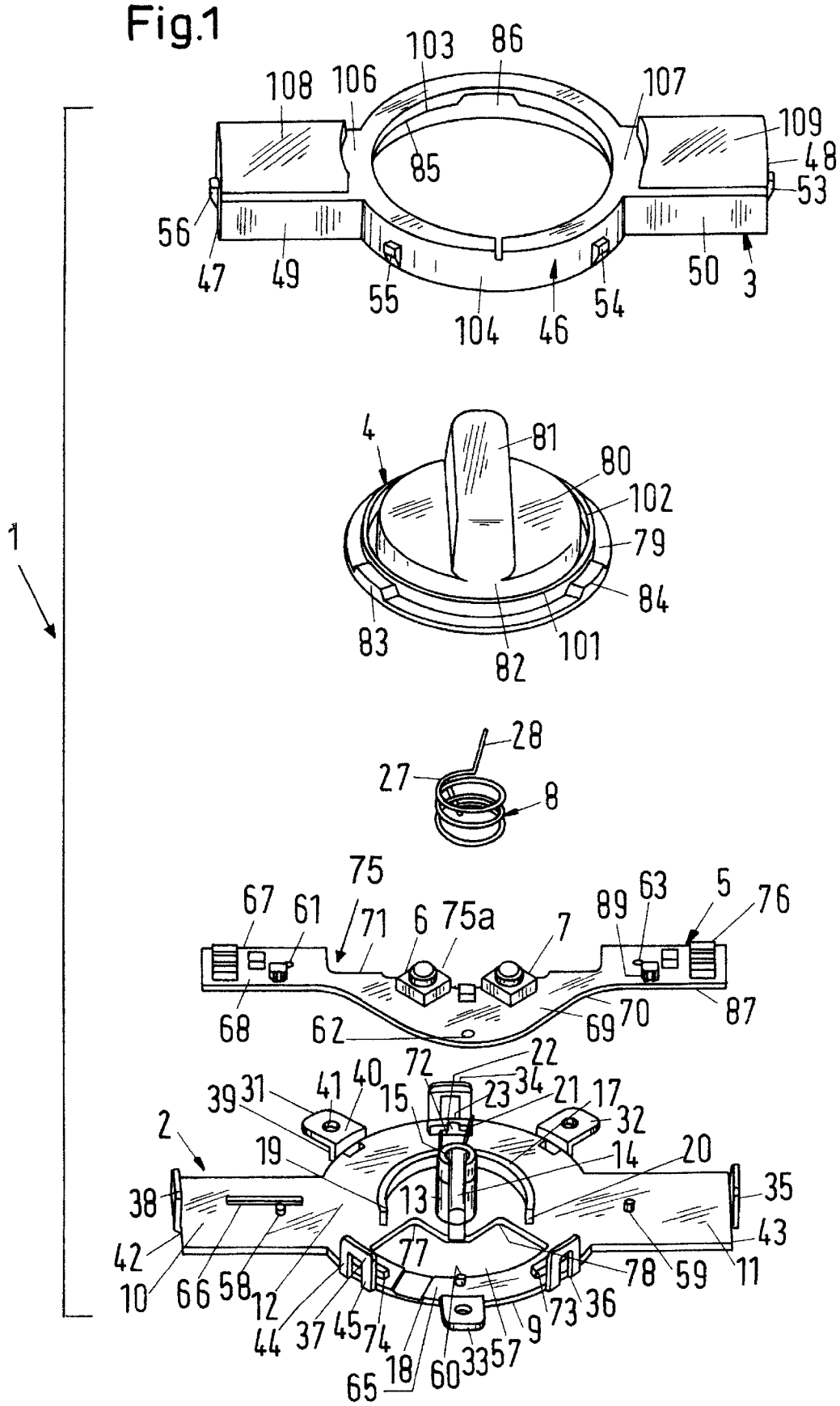
FIG. 1 shows the emergency call button according to the invention in an exploded view.

The switch or button 1 illustrated in FIGS. 1 through 8 serves as an emergency call button which is mounted within a motor vehicle. By actuating the button or switch 1, an emergency call to the police or to an automotive roadside assistance service can be triggered, for example, in the case of an accident or a broken-down vehicle. As illustrated in particular in FIG. 1, the switch or button 1 has a switch housing 2, 3 comprised of a bottom housing part 2 and a top housing part 3 in which an actuator part 4, which is adjustable against the force of a spring 8, is arranged to be axially slidable and rotatable. Moreover, the switch 1 has a printed circuit board 5 provided within the bottom housing part 2 which has two micro-switches 6, 7 as triggers. One micro-switch 6 is preferably provided for triggering an emergency call to an automotive roadside assistance service and the other micro-switch 7 for triggering an emergency call to the police, the fire department or the like.

The bottom housing part 2 of the housing has a circular disc-shaped base part or base plate 9 with two radially projecting and diametrically oppositely arranged arms 10 and 11. They have an elongate rectangular contour with a width which corresponds approximately to one fourth of the disc diameter. A central cylindrical bushing or insertion pin 13 projects past the inner side 12 of the base plate 9. It has a slot 14 extending axially along its length. The free end 15 of the bushing 13 is conically tapered in order to facilitate sliding or placing a cylindrical projection 16 (FIG. 4) of the actuator part 4 onto it.

Moreover, a part-circular stay 17 projects from the inner side 12 of the base plate 9 and is positioned coaxially to the bushing 13 approximately at half the radial width between the bushing 13 and the edge 18 of the base plate 9. The stay 17 extends advantageously across at least one half of the base plate 9. Preferably, its ends 19, 20 project past the longitudinal centerline of the bottom housing part 2. The stay 17 serves for increasing the shape stability of the bottom housing part 2. Its ends 19, 20 form abutments for the circuit board 5.

Figure 6:
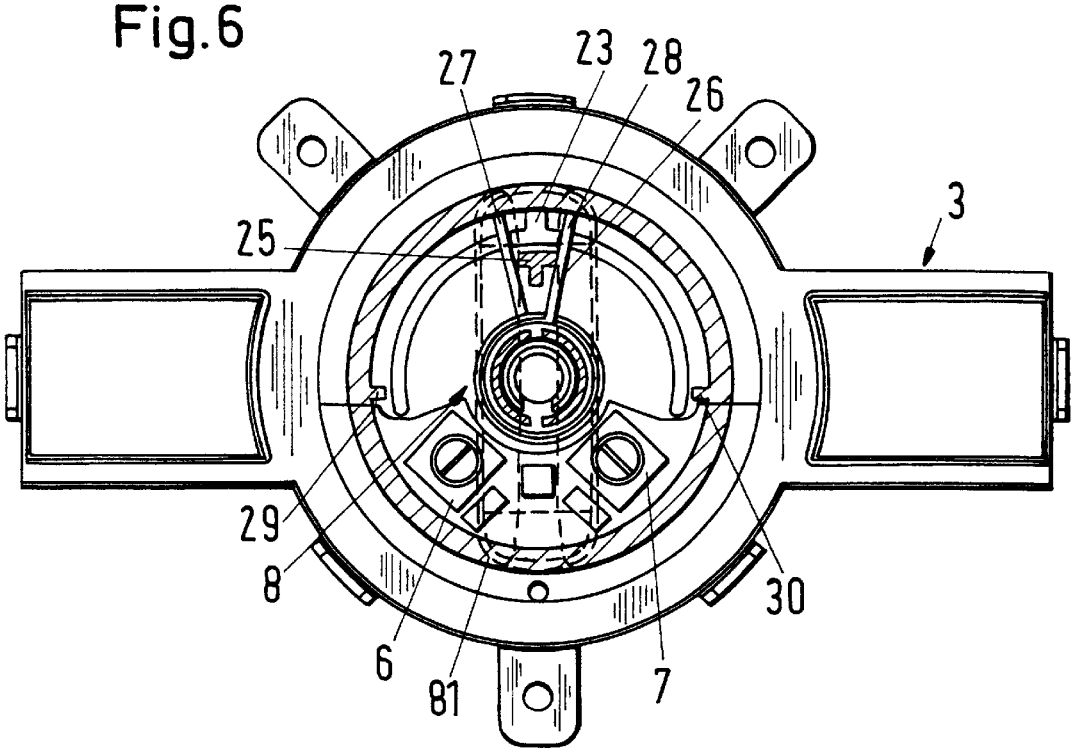
FIG. 6 is an illustration according to FIG. 3 with the actuator part in its rest position.
Figure 7:
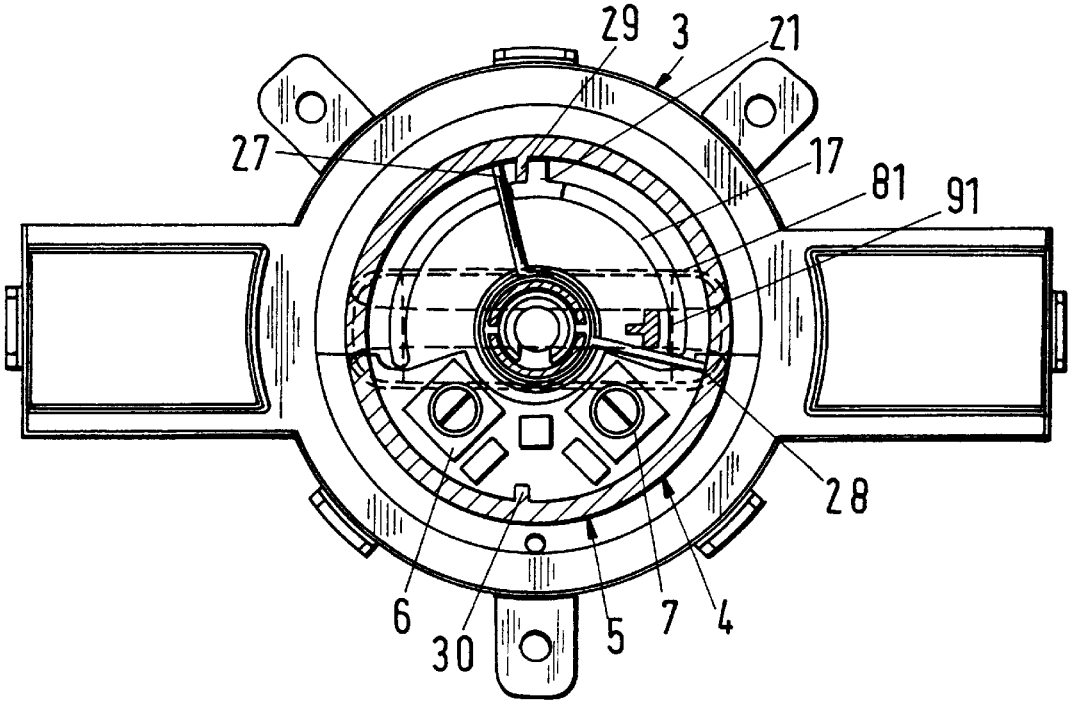
FIG. 7 shows the actuator part in an illustration corresponding to FIG. 6 in a first switching position.
Figure 8:
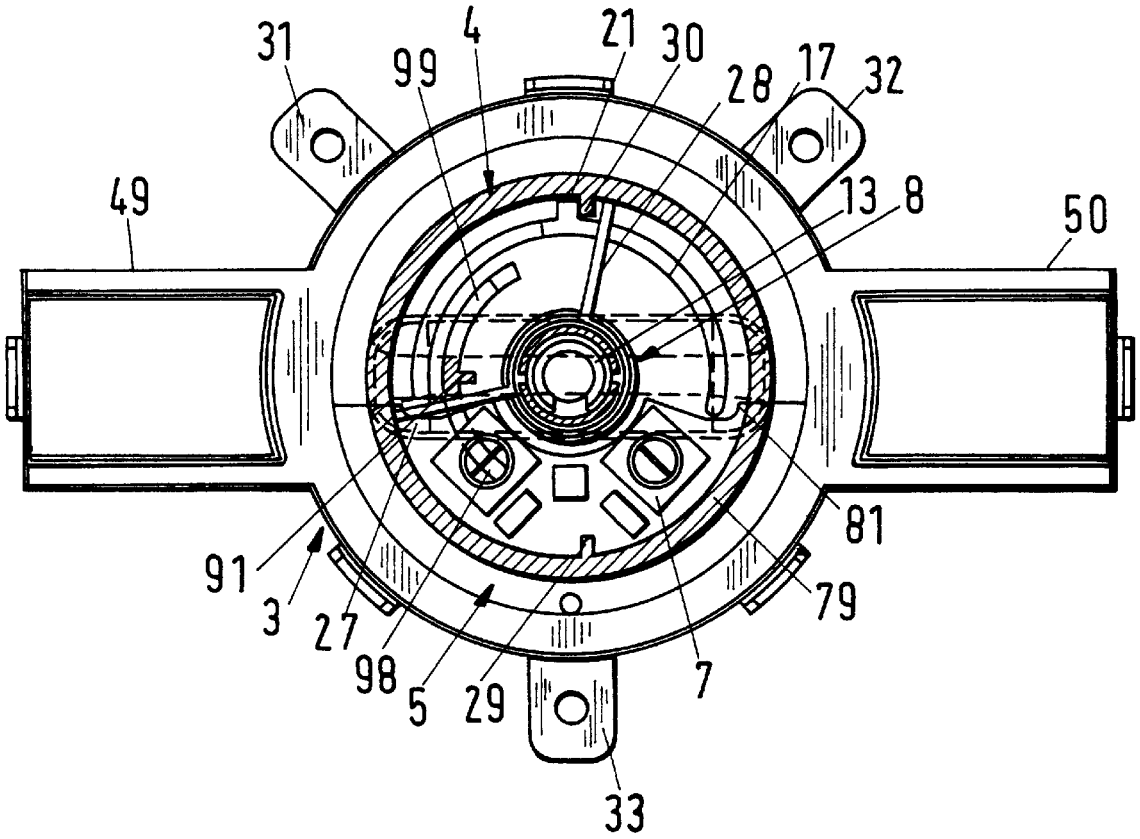
FIG. 8 shows the actuator part in an illustration corresponding to FIG. 6 in a second switching position.

A stop member 21 projects upwardly past the stay 17 and has a T-shaped cross-section. Its transverse stay 22 is curved like a part-circle and aligned with the stay 17 while its T-stay is straight and projects radially outwardly. The lateral edges 25, 26 of the transverse stay 22 extending perpendicularly to the upper edge 24 of the stay 17 serve as stops for two radially extending legs 27, 28 of the pressure spring 8 (FIG. 6). The T-stay 23 serves as a stop for first and second counter stops 29 and 30 of the actuator part 4 (FIGS. 6 through 8).

On the bottom housing part 2, in the area between the arms 10, 11 at the edge 18 of the base plate 9, securing parts in the form of attachment brackets 31 to 33 are provided with which the switch 1 can be attached at the mounting location within the vehicle. Moreover, on the edge 18 of the base plate 9 in the area between the arms 10, 11 and at the free ends 42, 43 of the arms 10, 11, locking members in the form of locking brackets 34–38 are provided. The attachment brackets 31–33 have an L-shaped cross-section. As illustrated by means of the attachment bracket 31, the attachment brackets 31–33 adjoin with their shorter leg 39 the edge 18 of the base plate 9. The longer leg 40 projects radially outwardly and has a central opening 41 to allow penetration by fastening screws and the like.

The attachment brackets 31–33 are of identical configuration, respectively, and are advantageously positioned with identical circumferential spacing from one another. The locking brackets 34, 36, 37 are positioned between neighboring attachment brackets 31, 32, 33, respectively, at identical spacing from them. The locking brackets 34, 36, 37 are also identical and have a U-shape.

They adjoin with the free ends of their legs 44, 45 the edge 18 of the base plate 9 and project from the base plate 9 perpendicularly upwardly. The locking brackets 34 to 38 rest against an annular part 46 and against the free end faces 47, 48 of the arms 49, 50 of the top housing part 3. The top housing part 3 is provided with locking members 51 to 56 (FIGS. 1 and 5) on its annular part 46 and on the end faces 47, 48 of its 20 arms 49, 50. The arms 49, 50 radially project from the annular part 46. When the switch or button 1 is mounted, the locking elements 51–56 engage the locking brackets 34 to 38 and thus connect the top housing part 3 with the bottom housing part 2.

The base plate 9 has a depression 57 into which the circuit board 5 projects with a projection (not illustrated) provided at its underside. The depression 57 is positioned opposite the stay 17 and its two ends are spaced with minimal spacing from the two ends 19, 20 of the stay 17.

For locking the circuit board 5 in place, approximately at half the width of the arms 10, 11 upwardly projecting pin elements 58, 59 are provided on the arms 10, 11 with minimal spacing to the base plate 9, and a pin element 60 is provided on the base plate 9. The circuit board 5 is provided with corresponding plug-in openings 61–63 for the pin elements 58 to 60. The pin 60 is positioned in the area between the edge 18 of the base plate 9 and the depression 57. Adjacent to the pin 58 an abutment stay 66 is provided extending in the longitudinal direction of the arm 10. The circuit board 5 rests with the rim 67 of one arm 68 against the stay 66 in order to prevent a transverse movement of the circuit board 5. Adjacent to the locking brackets 34, 36, 37, the base plate 9 has three stays 72–74 extending in the circumferential direction. The stays 73, 74 are positioned approximately at half the width of an edge portion 65 which is provided between the depression 57 and the edge 18 of the base plate 9. The stays 72–74 are identical and, like the locking brackets 34, 36, 37, of a part-circular shape. Their length is identical to the circumferential extension of the locking brackets 34, 36, 37. The printed circuit board 5 rests against the stays 73 and 74 with its outer curved edge 70 of the base body 69.

The circuit board 5 has a second arm 76 aligned with the arm 68 and positioned diametrically opposite thereto. The arms 68, 76 have a rectangular contour and are provided with the insertion or plug-in openings 61, 63. The arms 68, 76 delimit together with an inner rim 71 of the circuit board 5 a U-shaped recess 75 open at one side. The central area of the inner rim 71 is recessed slightly so that a further U-shaped recess 76 is formed which has only a minimal depth. It has triangular projections (not illustrated) which project positive-lockingly into corresponding triangular portions 77, 78 of the depression 57 of the bottom housing part 2. The micro-switches 6 and 7 are attached at the level of the projections to the circuit board 5.

Figure 2:
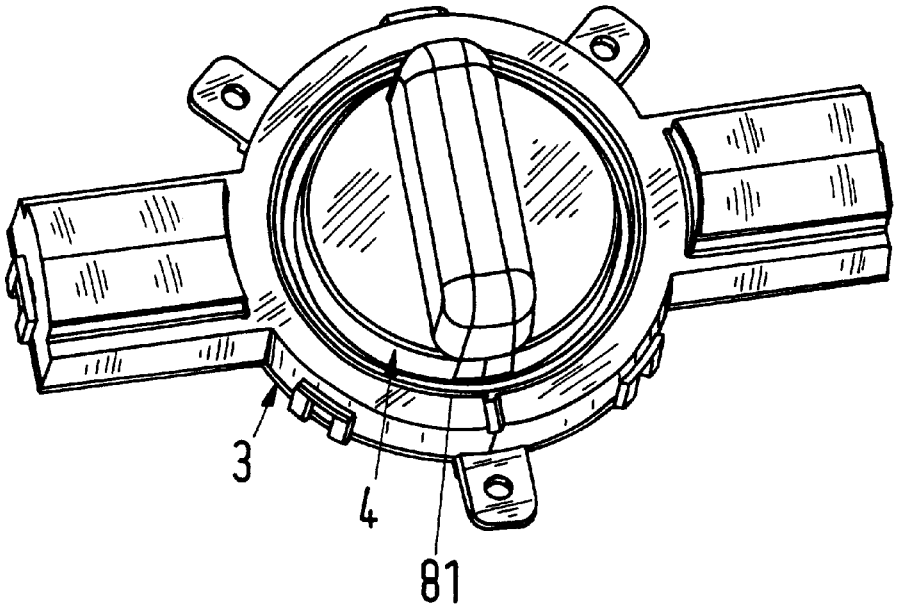
FIG. 2 shows the emergency call button according to FIG. 1 in a plan view.

As is shown in FIGS. 1 and 2, the actuator part 4 is cup-shaped with a peripheral rim 79 positioned in a radial plane. The bottom 80 of the actuator part 4 has an outwardly projecting, diametrically extending hollow profile stay 81 which forms a grip portion. On the rim 79 guiding and locking cams 83, 84 are provided which are arranged at a spacing to one another in the circumferential direction. They extend in the circumferential direction of the rim 79 and are approximately as wide as the rim 79. By means of the locking cams 83, 84, the actuator part 4, when rotated about its axis, glides in an annular groove 85 (FIG. 5) of the top housing part 3. In order to provide a securing action against rotation, the locking cams 83, 84 of the actuator part 4 are locked in corresponding locking cutouts 86, 87 (FIG. 5) of the top housing part 3.

Figure 4:
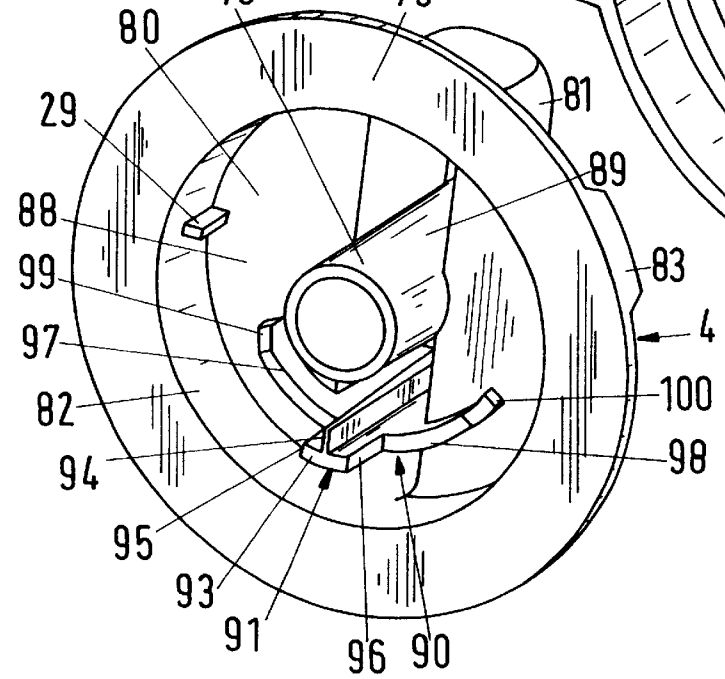
FIG. 4 is a perspective view of the actuator part in a view from below.

As illustrated in particular in FIG. 4, the central projection 16 of the actuator part 4 projects past the inner side 88 of the bottom 80. The projection 16 adjoins with its end portion 89 the inner side of the hollow profile stay 81 and is formed as a monolithic part thereof. The bottom 80 is connected by a cylindrical wall portion 82 with the rim 79.

As is illustrated in FIG. 4, the actuator part 4 has a trigger element 90 and a driver 91 formed as a monolithic driver part on the trigger element 90. The monolithic trigger element/driver part 90/91 is positioned at a spacing and coaxially to the projection 16. The trigger element 90 has two arms 97 and 98 which are curved in a part-circular shape and are formed as an elongate rectangular stay. They serve as triggers for the micro-switches 6 and 7. Upon rotation of the actuator part 4, the trapezoidally shaped tapered free ends 99, 100 of the arms 97, 98 slide onto one of the micro-switches 6, 7, respectively, depending on the rotational direction of the actuator part 4.

The driver part 91 is a stay having a T-shaped cross-section which is positioned symmetrically between the arms 97, 98 and projects axially past the arms 97, 98. The driver part 91 adjoins the inner side of the hollow profile stay 81 with which it is formed as a unitary or monolithic part. As illustrated in FIG. 4, the driver part 91 is positioned at a minimal spacing adjacent to the projection 16. In the rest position of the actuator part 4 (FIG. 6), the legs 27, 28 of the spring 8 rest against the axial lateral edges 95, 96 of the driver part 91. The transverse stay 93 of the driver part 91 is aligned, in the axial direction, with the arms 97, 98 and is thus correspondingly part-circularly curved. The T-stay 94 of the driver part 90 extends radially toward the projection 16 and thus projects radially inwardly.

The arms 97, 98 of the trigger element 90 extend approximately across half the radius of the actuator part 4.

Diametrically oppositely positioned counter stops 29, 30 project from the inner side of the wall portion 82 of the actuator part 4 in a radially inwardly oriented direction. They are formed by elongate rectangular stays which extend in the axial direction of the actuator part 4.

As illustrated in particular in FIG. 1, between the wall portion 82 and the rim 79 a circumferential groove 101 is formed. From the bottom of the groove 101 a cylindrical stay 102, extending coaxially to the wall portion 82, projects and surrounds the wall portion 82 at a spacing. The stay 102 rests against a circular stay 103 which is provided on the top housing part 3 and projects axially inwardly.

The top housing part 3 has a central annular part 46 (FIG. 1) which comprises the annular stay 103 and an outer annular wall 104 surrounding the stay 103. Between them (103, 104), the annular groove 85 is formed. The stay 103 is provided at its end faces with the locking cutouts 86, 87 extending in the circumferential direction. The arms 49, 50 project radially from the annular part 46 and are positioned diametrically opposite one another. The arms 49, 50 are hollow parts. They have at their upper side 106, 107 upwardly extending projections 108, 109, respectively.

In the mounted position of the switch 1, the printed circuit board 5 rests on the bottom housing part 2. The pin elements 58 to 60 of the bottom housing part 2 project into the plug-in openings 61 to 63 of the circuit board 5 which is thus reliably secured in its position. The abutment stay 66 and the annular stay 17 of the bottom housing part 2 contribute additionally to the securing action of the position of the circuit board 5; the circuit board 5 rests against the stays 66, 17 in its mounted position.

Figure 3:
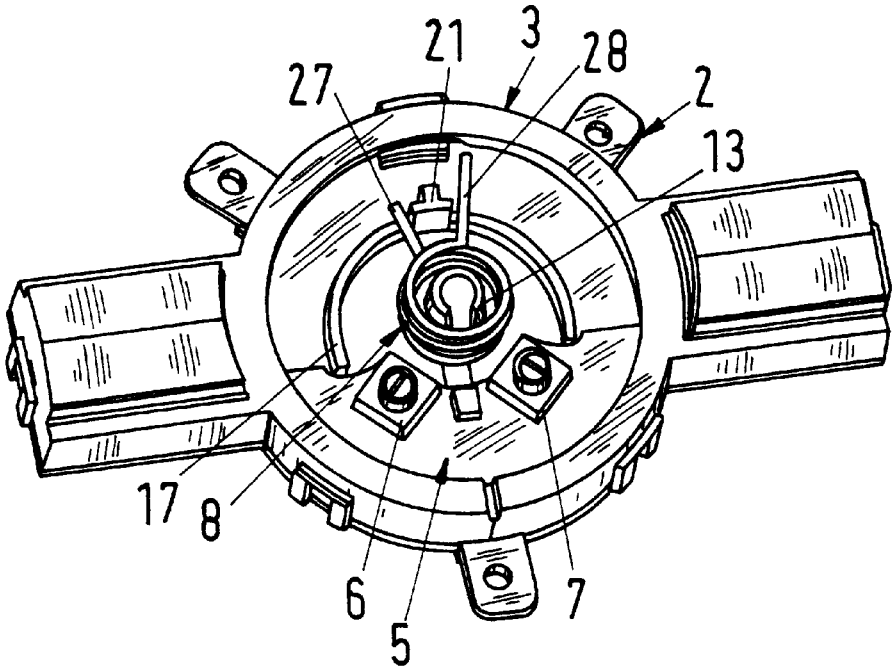
FIG. 3 shows the emergency call button according to FIG. 2 without actuator part.
Figure 5:
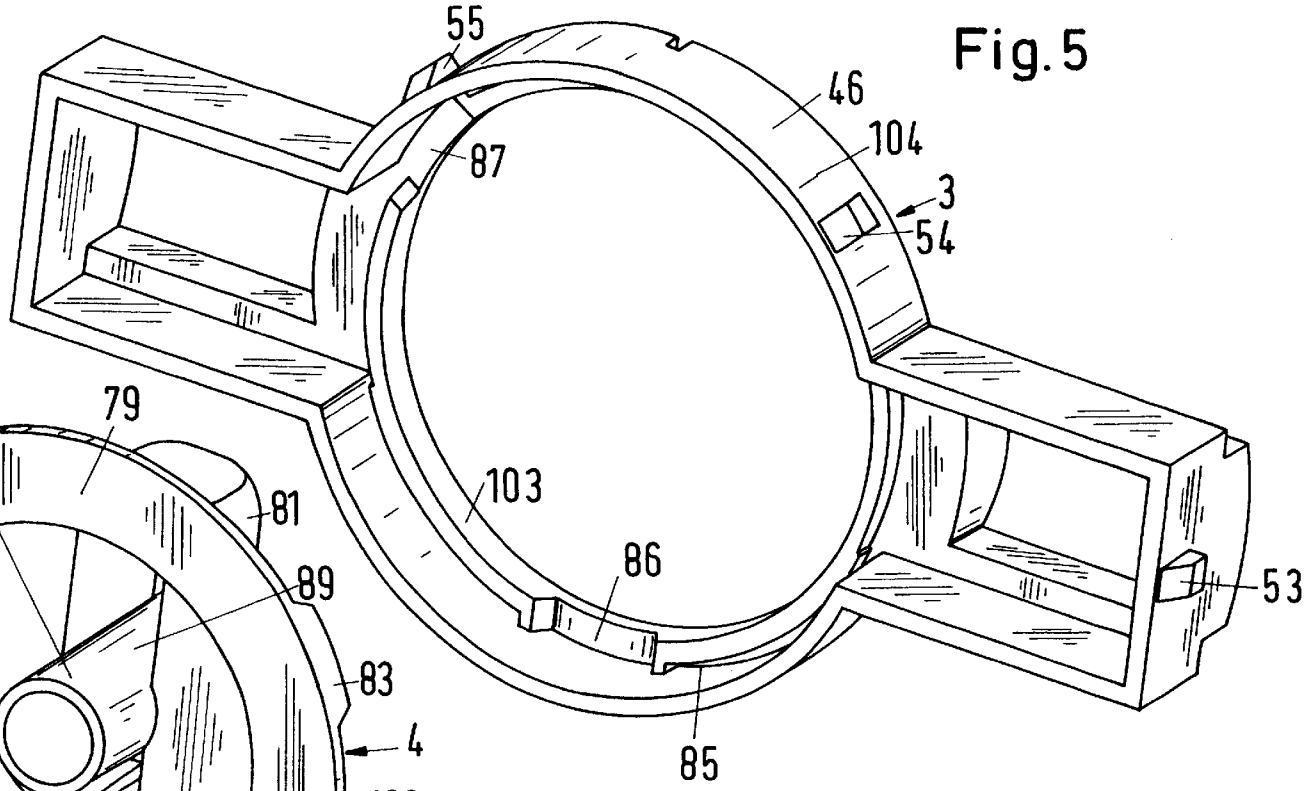
FIG. 5 shows the top housing part of the emergency call button according to FIG. 1 in a perspective illustration.

The spring 8 is seated on the bushing or insertion pin 13 of the bottom housing part 2. It is arranged such that, in the rest position of the actuator part 4, it rests with its legs 27, 28 against the stop member 21 of the annular stay 17 (FIGS. 3, 6). The actuator part 4 is seated on the bottom housing part 2 with the inserted circuit board 5 such that it is placed with the projection 16 onto the insertion pin 13. Subsequently, the top housing part 3 is positioned such that the locking cams 83, 84 of the actuator part 4 will come to rest in the locking cutouts 86, 87 of the annular part 46 of the top housing part 3. The top housing part 3 then rests with its arms 49, 50 above the arms 68, 76 of the circuit board 5 and above the arms 10, 11 of the bottom housing part 2. When connecting the top housing part 3, its locking elements 51 to 56 lock in the locking brackets 34 to 38 of the bottom housing part 2. The two housing parts 2, 3 are configured such that the actuator part 4 engages, under the force of the elastically compressed spring 8, with its locking cams 83, 84 the locking cutouts 86, 87 and rests with its rim 79, located in a radial plane, against the end face of the annular stay 103 of the top housing part 3. The locking cams 83, 84 and/or the locking cutouts 86, 87 in the stay 103 of the top housing part 3 are configured such that the actuator part 4 cannot be rotated out of its rest position (FIGS. 2, 3 and 6). Accordingly, the emergency call button 1 cannot be accidentally actuated, for example, by children.

For triggering an emergency call, the actuator part 4 must be pressed against the force of the spring 8 to such an extent that the locking cams 83, 84 will be released from the locking cutouts 86, 87. The actuator part (4) is now in its release position. Only now the actuator part 4 in the form of a turn knob can be rotated about its axis into the triggering position. Depending on the direction of rotation, one of its two arms 97, 98 will come into contact with one of the micro-switches 6, 7 on the printed circuit board 5. The part-circularly curved, stay-shaped arms 97, 98 will slide with their slanted portions 99, 100 onto the corresponding micro-switch 6, 7 into the triggering position in which the micro-switch 6, 7 is accordingly suppressed and the emergency call is triggered.

FIG. 7 shows the situation when the actuator part 4 has been rotated relative to its rest position according to FIG. 6 in the clockwise direction. The stay-shaped driver part 91, positioned between the arms 97, 98 and projecting axially past them, entrains upon rotation the spring leg 28 so that the actuator part 4 is loaded in the direction of its rest position when in its rotated position. When the actuator part 4 is released after the emergency call has been triggered (by suppressing the micro-switch), it is returned automatically into the rest position by the force of the spring 8. As soon as the locking cams 83, 84 reach the area of the locking cutouts 86, 87, the actuator part 4 is axially pushed back by the spring 8 so that the locking cams 83, 84 will lock in the locking cutouts 86, 87.

In order for the emergency call to be safely triggered, i.e., to rotate the actuator part 4 far enough, the actuator part 4 is provided with the counter stop 29 which will come to rest against the stop member 21 of the bottom housing part 2 when the actuator part 4 has been rotated far enough (FIG. 7).

When the actuator part is rotated counter-clockwise relative to the rest position according to FIG. 6 after having been pressed in (FIG. 8), the driver part 91 entrains the spring leg 27 so that the actuator part 4 in this rotational position is also spring-loaded in the direction of its rest position. By means of the arm 98, the micro-switch 6 is suppressed and the corresponding emergency call is triggered. In this triggering position the actuator part 4 rests with its counter stop 30 on the stop of the bottom housing part 2.

While specific embodiments of the invention have been shown and described in detail to illustrate the inventive principles, it will be understood that the invention may be embodied otherwise without departing from such principles.

What is claimed is:

1. An emergency call button for motor vehicles comprising at least one actuator part (4) and one or more triggers (6, 7), wherein the actuator part (4) is configured to act in a triggering position on one of the one or more triggers (6, 7) for triggering an emergency call, wherein the actuator part (4) has a rest position and is secured in the rest position against movement into the triggering position;

a housing comprising a first housing part (3) in which the actuator part (4) is locked in the rest position;

wherein the actuator part (4) comprises one or more trigger elements (90) for triggering the one or more triggers (6, 7).

2. An emergency call button according to claim 1, further comprising a spring (8), wherein the actuator part (4) is locked in the rest position under the force of the spring (8).

3. An emergency call button according to claim 1, wherein the actuator part (4) is configured to be moved from the rest position into a release position in which the actuator part (4) is no longer secured against movement into the triggering position.

4. An emergency call button according to claim 1, wherein the actuator part (4) is axially movable against the force of the spring (8) from the rest position into the release position.

5. An emergency call button according to claim 4, wherein the actuator part (4) has an axis of rotation and is configured to be rotated about the axis of rotation into the triggering position.

6. An emergency call button according to claim 1, wherein the first housing part (3) is an upper housing part.

7. An emergency call button according to claim 1, wherein the actuator part (4) is rotatably arranged in the first housing part (3).

8. An emergency call button according to claim 1, wherein the one or more trigger elements (90) each comprise two arms (97, 98) oriented in opposite directions and configured to act in the triggering position on one of the one or more triggers (6, 7).

9. An emergency call button according to claim 1, wherein the housing comprises a second housing part in the form of a bottom housing part (2), wherein two of the triggers (6, 7) are provided and arranged in the bottom housing part (2).

10. An emergency call button according to claim 1, wherein the one or more triggers (6,7) are micro-switches.

11. An emergency call button according to claim 1, further comprising a printed circuit board (5) arranged in the bottom housing part (2), wherein at least one of the triggers (6, 7) is mounted on the printed circuit board (5).

12. An emergency call button according to claim 1, wherein the printed circuit board (5) is position-secured in the bottom housing part (2).

13. An emergency call button according to claim 1, wherein the spring (8) is selected from the group consisting of a pressure spring, a rotary spring, and a pressure/rotary spring.

14. An emergency call button according to claim 13, wherein the bottom housing part (2) has a stop member (21) and wherein the spring (8) comprises two transversely projecting spring legs (27, 28), wherein the spring legs (27, 28) in the rest position of the actuator part (4) rests against the stop member (21) of the bottom housing part (2).

15. An emergency call button according to claim 14, wherein the stop member (21) has a T-shaped cross-section.

16. An emergency call button according to claim 14, wherein the stop member (21) extends axially.

17. An emergency call button according to claim 14, wherein the actuator part (4) comprises a grip portion (81) formed as a hollow body, wherein the trigger element (90) projects from the group portion (81).

18. An emergency call button according to claim 17, wherein the actuator part (4) has at least one counter stop (29, 30).

19. An emergency call button according to claim 18, wherein two of the counter stops (29, 30) are provided and are spaced from one another in the peripheral direction by approximately 180°.

20. An emergency call button according to claim 18, wherein the actuator part (4) has a cylindrical wall portion (82) and wherein the at least one counter stop (29, 30) projects radially inwardly from the cylindrical wall portion (82).

21. An emergency call button according to claim 18, wherein the actuator part (4) is cup-shaped and has a bottom (80).

22. An emergency call button according to claim 21, wherein the grip portion (81) is connected to and projects from the bottom (80) of the actuator part (4).

23. An emergency call button according to claim 21, wherein the actuator part (4) has a substantially cylindrical projection (16) connected to and projecting from the bottom (80).

24. An emergency call button according to claim 23, wherein the at least one trigger element (90) is positioned coaxially to the projection (16).

25. An emergency call button according to claim 24, wherein the bottom housing part (2) has a centrally arranged insertion pin (13) connected to the projection (16) of the actuator part (4).

26. An emergency call button according to claim 25, wherein the insertion pin (13) has a truncated cone-shaped tapered end (15).

27. An emergency call button according to claim 25, wherein the bottom housing part (2) comprises a base part (9), wherein the stop member (21) is provided on the base part (9).

28. An emergency call button according to claim 27, wherein the bottom housing part (2) comprises a securing stay (17) arranged concentrically to the insertion pin (13) and wherein the stop member (21) projects axially past the securing stay (17).

29. An emergency call button according to claim 14, wherein the actuator part (4) has at least one driver (91) for the spring legs (27, 28).

30. An emergency call button according to claim 29, herein the at least one driver (31) has a T-shaped cross-section.

31. An emergency call button according to claim 30, wherein the actuator part (4) has a bottom (80) and a cylindrical projection (16) connected to and projecting from the bottom (80) and wherein the at least one driver (91) has a transverse stay (93) extending coaxially to the projection (16) of the actuator part (4).

32. An emergency call button according to claim 31, wherein the at least one driver (91) projects away from the bottom (80) of the actuator part (4) axially past the on or more trigger elements (90).

33. An emergency call button according to claim 32, wherein each one of the one or more trigger elements (90) comprises two arms (97, 98).

34. An emergency call button according to claim 33, wherein the two arms (97, 98) of the one or more trigger elements (90) have trapezoidally tapered ends (99, 100).

35. An emergency call button according to claim 33, wherein the two arms (97, 98) of the one or more trigger elements (90) have a radius of curvature identical to a radius of curvature of the transverse stay (93) of the at least one driver (91).

36. An emergency call button according to claim 1, wherein the actuator part (4) has a radially outwardly projecting peripheral rim (79) having one or more locking cams (83, 84) projecting upwardly from the circumferential rim (79).

37. An emergency call button according to claim 1, wherein three of the locking cams (83, 84) are positioned on the peripheral rim (79) and are spaced from one another by identical radial spacing.

38. An emergency call button according to claim 1, wherein the first housing part is an upper housing part (3) having locking cutouts (86, 87), wherein the one or more locking cams (83, 84) in the rest position of the emergency call button (1) engage the locking cutouts (86, 87).

39. An emergency call button according to claim 1, wherein the upper housing part (3) has an annular stay (103) and wherein the locking cutouts (86, 87) are located on the annular stay (103).

40. An emergency call button according to claim 1, wherein the top housing part (3) has an annular part (46) and wherein the annular stay (103) is provided on the annular part (46).

41. An emergency call button for motor vehicles comprising at least one actuator part (4) and one or more triggers (6, 7), wherein the actuator part (4) is configured to act in a triggering position on one of the one or more triggers (6, 7) for triggering an emergency call, wherein the actuator part (4) has a rest position and is secured in the rest position against movement into the triggering position;

a housing comprising a first housing part (3) in which the actuator part (4) is locked in the rest position;

wherein the first housing part is a top housing part (3) having two diametrically oppositely arranged arms (49, 50);

wherein the housing has a second housing part in the form of a bottom housing part (2), wherein the bottom housing part (2) has diametrically oppositely arranged arms (10, 11), wherein a printed circuit board (5) is arranged in the bottom housing part (2) and has diametrically oppositely arranged arms (68, 76), wherein the arms (49, 50) of the top housing part (3) cover the arms (10, 11; 68, 76) of at least one of the bottom housing part (2) and of the printed circuit board (5).

42. An emergency call button according to claim 41, wherein the arms (49, 50) of the top housing part (3) are formed as hollow bodies.

43. An emergency call button according to claim 41, wherein the bottom housing part (2) has an annular disk-shaped base part (9) and a stop member (21) connected to the base part (9), wherein the arms (10, 11) of the bottom housing part (2) and the stop member (21) project away from the base part (9).

44. An emergency call button according to claim 41, wherein the printed circuit board (5) has a semi-circular base body (69) on which the one or more triggers (6, 7) are arranged.

45. An emergency call button according to claim 44, wherein the bottom housing part (2) has locking members (34–38) and wherein the top housing part (3) has counter locking elements (51–56), wherein in the assembled state of the bottom housing part (2) and the top housing part (3) the locking members (34–38) and the counter locking elements (51–56) are snapped into place with one another.

46. An emergency call button according to claim 45, wherein the locking members (34–38) are provided on at least one of an edge of the base part (9) and the arms (10, 11) of the bottom housing part (2).

47. An emergency call button according to claim 46, wherein the locking members (34–38) are bracket-shaped.

48. An emergency call button according to claim 46, wherein several of the locking members (34, 36, 37) are provided on the base part (9) of the bottom housing part (2) and one of the locking members (35, 38) is provided on the arms (10, 11) of the bottom housing part (2) at the end face of the arms (10, 11), respectively.

49. An emergency call button according to claim 48, wherein three locking members (34, 36, 37) are provided on the base part (9) and are spaced at identical circumferential spacing to one another.

50. An emergency call button according to claim 48, wherein the bottom housing part (2) has securing parts (31–33) for attaching the emergency call button in the vehicle.

51. An emergency call button according to claim 50, wherein the securing parts (31–33) are attachment brackets provided on the base part (9).

52. An emergency call button according to claim 33, further comprising a spring (8), wherein the actuator part (4) is locked in the rest position under the force of the spring (8).

53. An emergency call button according to claim 33, wherein the actuator part (4) is configured to be moved from the rest position into a release position in which the actuator part (4) is no longer secured against movement into the triggering position.

54. An emergency call button according to claim 33, wherein the actuator part (4) is axially movable against the force of the spring (8) from the rest position into the release position.

55. An emergency call button according to claim 54, wherein the actuator part (4) has an axis of rotation and is configured to be rotated about the axis of rotation into the triggering position.

56. An emergency call button according to claim 33, wherein the first housing part (3) is an upper housing part.

57. An emergency call button according to claim 33, wherein the actuator part (4) is rotatably arranged in the first housing part (3).

* * * * *